US008899070B2

(12) United States Patent
Eckartsberg et al.

(10) Patent No.: US 8,899,070 B2
(45) Date of Patent: Dec. 2, 2014

(54) REFRIGERATION DEVICE WITH A HOLDER FOR A SECTION OF A REFRIGERANT LINE

(75) Inventors: Peter Eckartsberg, Aalen (DE); Michael Kordon, Gerstetten (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 605 days.

(21) Appl. No.: 12/679,698

(22) PCT Filed: Sep. 9, 2008

(86) PCT No.: PCT/EP2008/061933

§ 371 (c)(1),
(2), (4) Date: Mar. 24, 2010

(87) PCT Pub. No.: WO2009/047067

PCT Pub. Date: Apr. 16, 2009

(65) Prior Publication Data

US 2010/0199708 A1 Aug. 12, 2010

(30) Foreign Application Priority Data

Oct. 1, 2007 (DE) ..... 10 2007 047 006

(51) Int. Cl.

| | |
|---|---|
| ***F25D 19/00*** | (2006.01) |
| ***F25B 1/00*** | (2006.01) |
| ***F25D 21/00*** | (2006.01) |
| ***F25D 21/04*** | (2006.01) |
| ***F24F 13/22*** | (2006.01) |
| *F24F 13/30* | (2006.01) |

(52) U.S. Cl.

CPC ..... *F25D 21/04* (2013.01); *F24F 13/22* (2013.01); *F24F 13/30* (2013.01); *F24F 2013/221* (2013.01)

USPC ..... 62/452; 62/272; 62/453; 62/498

(58) Field of Classification Search

CPC ..... F24F 13/22; F24F 13/26; F24F 13/30; F24F 2013/221

USPC ..... 62/169, 272, 255, 248, 440, 452, 453, 62/498

See application file for complete search history.

(56) References Cited

U.S. PATENT DOCUMENTS 2,516,586 A * 7/1950 Peltier ..... 62/272
2,669,853 A * 2/1954 Spiegelhalter ..... 62/453

(Continued)

FOREIGN PATENT DOCUMENTS

DE 2548764 A1 5/1977
JP 52-24259 U 2/1977

(Continued)

OTHER PUBLICATIONS

RU2010112830 Granting Decision.

*Primary Examiner* — Ljiljana Ciric
(74) *Attorney, Agent, or Firm* — Nixon & Vanderhye, P.C.

(57) ABSTRACT

A method for preventing condensation on a surface of a domestic refrigeration device and a corresponding domestic refrigeration device having a refrigerated chamber, a refrigerant line, and a refrigerant circulation system structured to transfer heat energy from the refrigerated chamber into the refrigerant circulation system via the refrigerant line. The refrigerant line may include a heat-emitting section in heat-conducting contact with a trim strip of the refrigeration device running below the refrigerated chamber.

35 Claims, 3 Drawing Sheets

(56) References Cited

U.S. PATENT DOCUMENTS

| | | | | | |
|---|---|---|---|---|---|
| 2,706,894 | A | * | 4/1955 | Shoemaker | 62/272 |
| 3,055,193 | A | * | 9/1962 | Smith | 62/440 |
| 3,112,624 | A | * | 12/1963 | Rill, Jr. | 62/440 |
| 3,324,679 | A | * | 6/1967 | Benasutti et al. | 62/272 |
| 3,650,122 | A | * | 3/1972 | Lieberman | 62/440 |
| 3,655,939 | A | * | 4/1972 | Stromquist | 62/248 |
| 3,697,723 | A | * | 10/1972 | Winsler et al. | 62/248 |
| 3,869,873 | A | * | 3/1975 | Thomas | 62/440 |
| 4,474,017 | A | | 10/1984 | Prada | |
| 4,586,348 | A | | 5/1986 | Nakayama et al. | |
| 4,735,062 | A | | 4/1988 | Woolley et al. | |
| 4,852,303 | A | * | 8/1989 | Rolek | 62/248 |
| 4,944,157 | A | * | 7/1990 | Jenkins et al. | 62/440 |
| 5,035,085 | A | * | 7/1991 | Mamelson et al. | 62/248 |
| 5,277,035 | A | * | 1/1994 | Fristoe et al. | 62/277 |
| 5,701,751 | A | * | 12/1997 | Flores | 62/169 |
| 5,725,294 | A | * | 3/1998 | Froelicher | 62/453 |
| 6,090,422 | A | * | 7/2000 | Taragan et al. | 62/169 |
| 6,393,855 | B1 | * | 5/2002 | Schuchert et al. | 62/277 |
| 6,655,169 | B2 | * | 12/2003 | Tupis et al. | 62/440 |
| 6,666,043 | B2 | * | 12/2003 | Lee | 62/283 |
| 6,783,199 | B2 | * | 8/2004 | Parrott | 62/248 |
| 8,220,288 | B2 | * | 7/2012 | Gorz et al. | 62/440 |

FOREIGN PATENT DOCUMENTS

| | | | |
|---|---|---|---|
| JP | 1-181077 | A | 7/1989 |
| JP | 2-144388 | U | 12/1990 |
| JP | 8303934 | A | 11/1996 |
| JP | 2003139417 | A | 5/2003 |
| SU | 807008 | A1 | 2/1981 |

* cited by examiner

REFRIGERATION DEVICE WITH A HOLDER FOR A SECTION OF A REFRIGERANT LINE

This application is a U.S. National Phase of International Application No. PCT/EP2008/061933, filed Sep. 9, 2008, which designates the U.S. and claims priority to German Application No. 10 2007 047 006.3, filed Oct. 1, 2007, the entire contents of each of which are hereby incorporated by reference.

BACKGROUND OF THE INVENTION

The present invention relates to a refrigeration device having a refrigerant circulation system connected by a refrigerant line to a refrigerant compressor, a condenser and an evaporator for the transfer of heat energy from a refrigerated chamber of the refrigeration device into the refrigerant circulation system, and a heat-emitting section of the refrigerant line which is in heat-conducting contact with at least one trim strip which forms a contact surface for a door seal.

DE 25 48 764 A1 describes a device for preventing the formation of condensation on the surface of a refrigerator or freezer, wherein the cabinet consists of an inner container, foam insulation and an outer casing which is essentially made up of sidewalls. To prevent condensation, the contact surfaces of the door seal are heated by running a pipe inserted into the high-pressure section of the refrigerating unit along the side of the contact surface facing the foam. From the accompanying drawing it can be seen that the pipe is run inside the foam insulation and parallel to the contact surfaces.

U.S. Pat. No. 4,586,348 discloses a refrigeration device having a metal cabinet with a left and right sidewall, and a top wall connecting the sidewalls. The cabinet is made from a metal sheet, the front edges of which are bent inward at right angles and then folded over through 180° to form contact surfaces for a seal. An edge section adjacent to the fold is bent inward in a U-shaped manner to form a clamp mounting for the edges of an inner box. At the bottom of the U-shaped bend, a hollow channel remains in which a refrigerant pipe of the warm side of the refrigerant circulation is run to prevent condensation water on the contact surfaces. After folding of the cabinet, the refrigerant pipe is installed in the hollow channel and then the inner box is mounted. The cavity formed between outer cabinet and inner box is finally filled with foam insulation.

A similar arrangement is described in U.S. Pat. No. 4,735,062. There too, the refrigerant pipe is run along the contact surfaces in a fold in the outer cabinet to prevent condensation water on the contact surfaces for a door seal of the refrigeration device. After the mounting of an inner container, a cavity formed between outer cabinet and inner container is filled with foam insulation. The refrigerant pipe is run completely along the two lateral and the upper contact surface of the freezer compartment, the lower contact surface being implemented without refrigerant pipe.

Also in the generic U.S. Pat. No. 4,474,017, to prevent condensation water on the contact surfaces for a door seal, a refrigerant pipe is provided which extends along the two lateral and the upper contact surface of the freezer compartment. However, in contrast to the above described prior art, the refrigerant pipe is not loosely inserted or clamped in the fold of the outer cabinet prior to foaming, but fixed by means of a separate holder. For this purpose, the holder is clamped to the refrigerant pipe and then the holder is clamped in the fold together with the section of the refrigerant pipe. The refrigerant pipe fixed by means of the holder is then embedded in foam.

BRIEF SUMMARY OF THE INVENTION

The object of the invention is to optimize the heat transfer from a refrigerant line to a contact surface for a door seal.

By arranging that the heat emitting section of the refrigerant line is at least predominantly and, advantageously, exclusively in heat-conducting contact with a trim strip running below the refrigerated chamber, the installation length of the additional pipe loop can be kept as short as possible, so that any carryover of heat into the refrigeration device is largely eliminated, thereby improving the energy efficiency of the refrigeration device. In addition, significant savings can be made in respect of the material that would be required if the pipe loop were to be run via all four trim strips of the frame-shaped contact surface for the door seal. It has been found that unwanted condensation water formation is essentially only likely to occur, particularly in the case of refrigerator and crisper compartments, on the trim strips running below the refrigerated chamber.

The heat-emitting section of the refrigerant line can also be in heat-conducting contact with only part of the trim strip running below the refrigerated chamber. It has been found that, for effective heating, the lower trim strip does not necessarily have to be in heat-conducting contact completely over its entire length with a section of the refrigerant line. Rather it has been found that it suffices for only part of said trim strip to be heated. The heat introduced directly via the section of the refrigerant line spreads sufficiently rapidly due to thermal conduction within the metal trim strip, so that areas of the trim strip not directly adjacent to the section of the refrigerant line are also sufficiently supplied with heat. Improved heat transfer over only a short section has the advantage that only the necessary area of the trim strip needs to have heat applied to it. Reducing the section of the refrigerant line in contact with the trim strip prevents heat from spreading into the interior, which can occur if, as in the prior art, the refrigerant line were to run extensively or even completely around the appliance. This would result in longer compressor operating times and therefore increased energy consumption. In addition to improving the heat transfer, the inventive holder also simplifies the assembly of the refrigeration device and, because of the precisely reproducible position of the refrigerant line, results in a reduction in the technical error rate. For this purpose, the pre-fixed holder for fixing the section of the refrigerant line is implemented only via part of the lower, horizontally running trim strip.

The heat-emitting section of the refrigerant line can be in heat-conducting contact with the trim strip over a length of between 50% and 25% of the latter's total longitudinal extent. Accordingly, the pre-fixed holder for fixing the section of the refrigerant line is also preferably implemented over a length of between 50% and 25% of the total longitudinal extent of the lower, horizontally running trim strip. This ensures a sufficiently rapid and even heat distribution along the total longitudinal extent of the trim strip for the shortest possible section of the refrigerant line. Another result of this is that the inventive holder, which is preferably made of plastic, can be very small-sized, which makes it less expensive to produce than a much larger holder, which would require a greater amount of plastic material for its manufacture.

The heat-emitting section of the refrigerant line can be in heat-conducting contact with the trim strip in a central region thereof. In particular, the pre-fixed holder for fixing the section of the refrigerant line can also be implemented here in a central region of the lower, horizontally running trim strip. Due to the central mounting of the holder, heat is distributed evenly and with the same speed and magnitude by thermal conduction in the two opposite directions along the longitudinal extent of the trim strip.

The section of the refrigerant line can be formed from part of a pipe loop of the high-pressure side of the refrigerant circulation system, extending from a rear side to the trim strip in the region of the base of the refrigeration device. In the region of the base, the pipe loop of the high-pressure side of the refrigerant circulation system can be run outside a thermal insulation or even freely. As the pipe loop runs outside the thermal insulation, no heat can be carried over from the pipe run into the interior of the refrigeration device. On the other hand, the heat exchanger length of the refrigerant circuit is increased, as the refrigerant line is lengthened overall and heat can be additionally discharged to the ambient particularly in the region of the pipe loop, resulting in an improvement in energy consumption overall.

The heat-emitting section of the refrigerant line can be in heat-conducting contact with the trim strip by means of a holder pre-fixed to the trim strip. The holder is used to fix a section of the refrigerant lines along the back of trim strips which form the contact surfaces for a door seal. In order to optimize the heat transfer from the refrigerant line to the contact surface for the door seal, the inventive holder has first retaining means for pre-fixing the holder to the back of the trim strips and second retaining means for fastening the section of one of the refrigerant lines for the pre-fixed holder. The holder can, by virtue of the first retaining means, be fastened to the trim strip at a predetermined location in a precisely defined position. This ensures a well-defined and precisely reproducible position of the holder with respect to the trim strip. The second retaining means position and fix the section of the refrigerant line in an equally well-defined and precisely reproducible position with respect to the holder, so that an altogether well-defined and precisely reproducible positioning of the section of the refrigerant line with respect to the trim strip can be achieved. By ensuring this well-defined position, the heat transfer from a refrigerant line to a contact surface for a door seal can be more accurately determined, so that an improvement in energy efficiency can be achieved.

The refrigerant line section to be held can be formed by part of the refrigerant circulation preferably either slightly upstream or downstream of the condenser. The refrigerant line section to be held is therefore formed by the overpressure side of the refrigerant circulation which has much higher temperatures than in the region of the low-pressure side which is unsuitable for providing heat. In order to transfer the heat from the section of the refrigerant line to the preferably metal trim strip, the inventive holder is provided which in this respect constitutes a connecting element. Said connecting element, i.e. the holder, ensures reliable heat transfer from the heat pipe to the metal trim strip. To enable the connecting element to perform its functions, it must be fixed to the trim strip. This can be realized by a force-fit or a form-fit connection. The connecting element is preferably made of plastic and is snapped into the trim strip.

In all the variants of the invention, the first retaining means can be a snap-in element holding in a form-fitting manner. The snap-in element fixes the holder to the back of a trim strip of the refrigeration device. The trim strip is part of a folded-over edge section of a sheet metal wall of the refrigeration device. The trim strip can be the base of an edge section that is folded over in a U-shaped manner. The holder is clamped or locked by means of the first retaining means between the two legs of the edge section folded over in a U-shaped manner.

The snap-in element can in particular be designed for locking in a form-fit manner to a bent sheet metal section of the trim strip. Form-fit locking ensures positionally correct fixing of the holder to the trim strip. For this purpose, one or more snap-in elements can be provided on the holder. Each snap-in element can carry a latching lug or latching projection which engages in a corresponding cutout on said bent sheet metal section of the trim strip where it locks into place. The counter-snap-in element corresponding to the snap-in element is in this respect produced by one or more stampings in a bent sheet metal part of the trim strip.

The second retaining means can be designed to fasten the section of the refrigerant line as one or more locking clips which grip the section of the refrigerant line in a pincer-like manner. The one or more second retaining means are implemented in one piece with the holder. The second retaining means can in particular be adapted to the contour of the section of the refrigerant line to be held. If the refrigerant line has a circular cross section, the locking clips gripping the section of the refrigerant line in a pincer-like manner can be in the shape of a circular arc.

Each locking clip can have two opposite latching tongues each having a clamping surface for opposite sides of the section of the refrigerant line and a thrust bevel for widening the latching tongues when the section of the refrigerant line is pressed into the locking clip. If the section of the refrigerant line is pressed outward against the two thrust bevels of two opposite latching tongues, the press-in force causes the opposite latching tongues to be spread apart. This forces the latching tongues apart so that the locking clip is widened such that the section of the refrigerant line can get behind the latching tongues. Because of the elastic material properties of the latching tongues, i.e. the holder, the latching tongues return to their original positions and the section of the refrigerant line snaps into the holder. As both the locking clips for fixing the section of the refrigerant line and the snap-in elements for fixing the holder to the trim strip are fixedly connected to the holder or can be implemented in one piece with same, the precise mounting position of the section of the refrigerant line with respect to the trim strip can be reproducibly defined.

BRIEF DESCRIPTION OF THE DRAWINGS

An embodiment of the invention will now be described with reference to a refrigeration device illustrated in the accompanying drawings. Further general features and advantages of the present invention will emerge from this concrete example, in which.

DETAILED DESCRIPTION OF EXEMPLARY EMBODIMENTS OF THE PRESENT INVENTION

Figure 1:
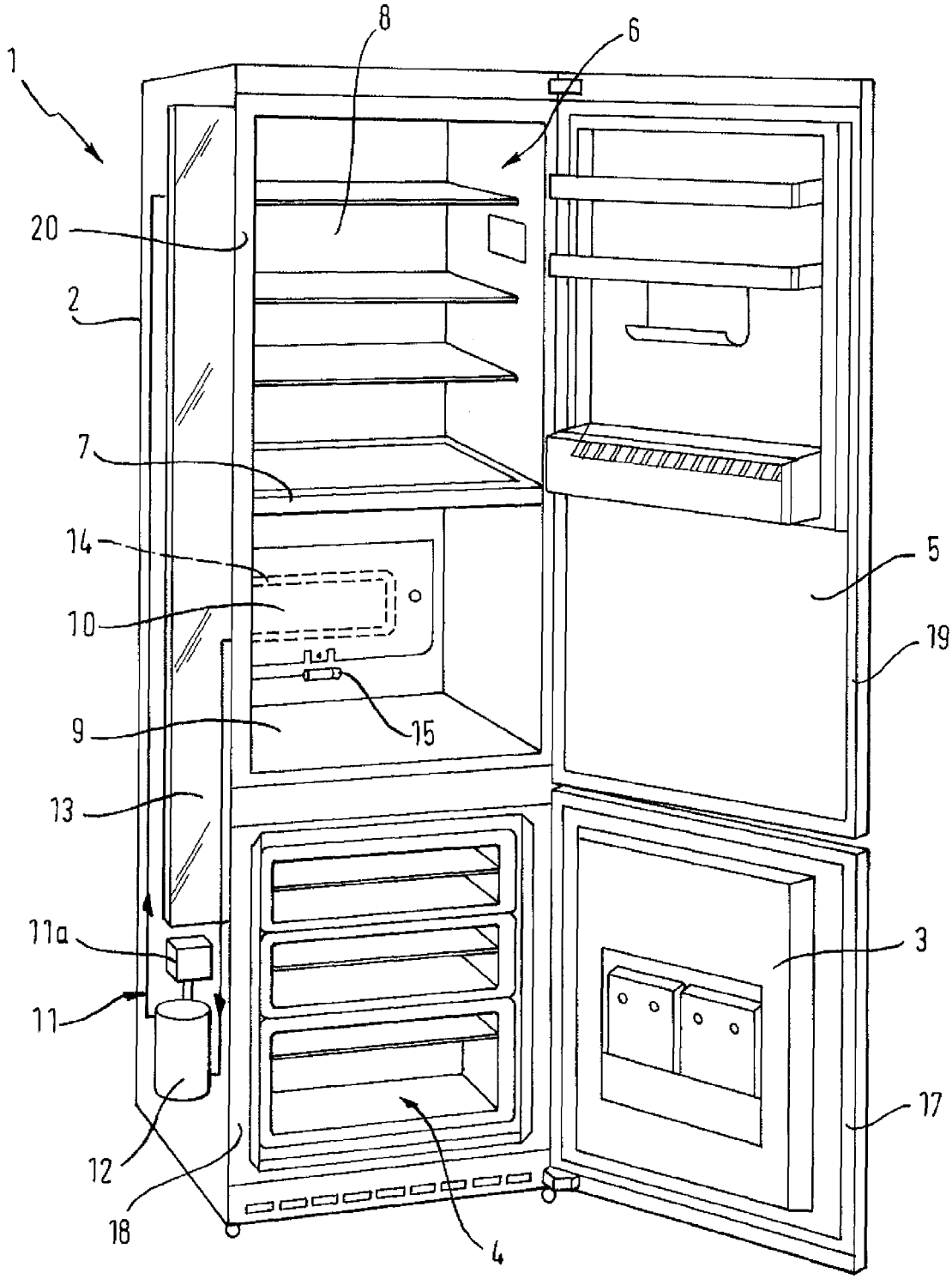
FIG. 1 shows a perspective view of a refrigeration device with a refrigerant circulation system.

A refrigeration device 1 according to FIG. 1 has a double-walled, foam-insulated cabinet 2 which forms a lower freezer compartment 4 sealable by means of a first door 3 and a refrigerated chamber 6 sealable by means of a separate second door 5. The refrigerated chamber 6 is divided by a partition 7 into an upper refrigerator compartment 8 and a lower crisper compartment 9. The crisper compartment 9 is operated at temperatures just above 0° C. and is preferably used to retain the freshness of perishable items such as vegetables and salads. The refrigerator compartment 8 is operated at temperatures of approximately 8° to 6° C. and is used to store the other chilled items. In the refrigeration device 1 illustrated, an evaporator plate 10 is shown by way of example on a rear internal wall of the crisper compartment 9. For simplicity of representation, the evaporator plate 10 is shown in FIG. 1 without fittings and with the crisper compartment drawers removed. The refrigeration device 1 can be operated by means of a refrigerant circulation system 11. For this purpose, the refrigerant circulation system 11 generally has a refrigerant compressor 12, a condenser 13 and an evaporator 14 which is connected in a heat conducting manner to the evaporator plate 10 and is used to transfer heat energy from a refrigerated chamber of the refrigeration device 1 into the refrigerant circulation system 11. Among other things, the temperature of the evaporator plate 10 can be used for open- or closed-loop control of the refrigerant circulation system 11 via a control unit 11*a*. To determine the temperature of the evaporator plate 10, a temperature sensor 15 can be used which is fastened in the refrigeration device 1 by means of a holder 16 such that its sensor surface 17 can measure the temperature of the evaporator plate 10.

Attached to the inside of the first door 3 is a circumferentially framing first door seal 17 which, when the first door 3 is closed, sealing the freezer compartment 4, is in contact with a first trim strip 18 of the refrigeration device 1 which runs around the freezer compartment 4. In the same way, there is attached to the inside of the second door 5 a circumferentially framing second door seal 19 which, when the second door 5 is closed, sealing the refrigerator compartment 8 and the crisper compartment 9, is in contact with a second trim strip 20 of the refrigeration device 1 which runs around the refrigerator compartment 8 and the crisper compartment 9.

Figure 2:
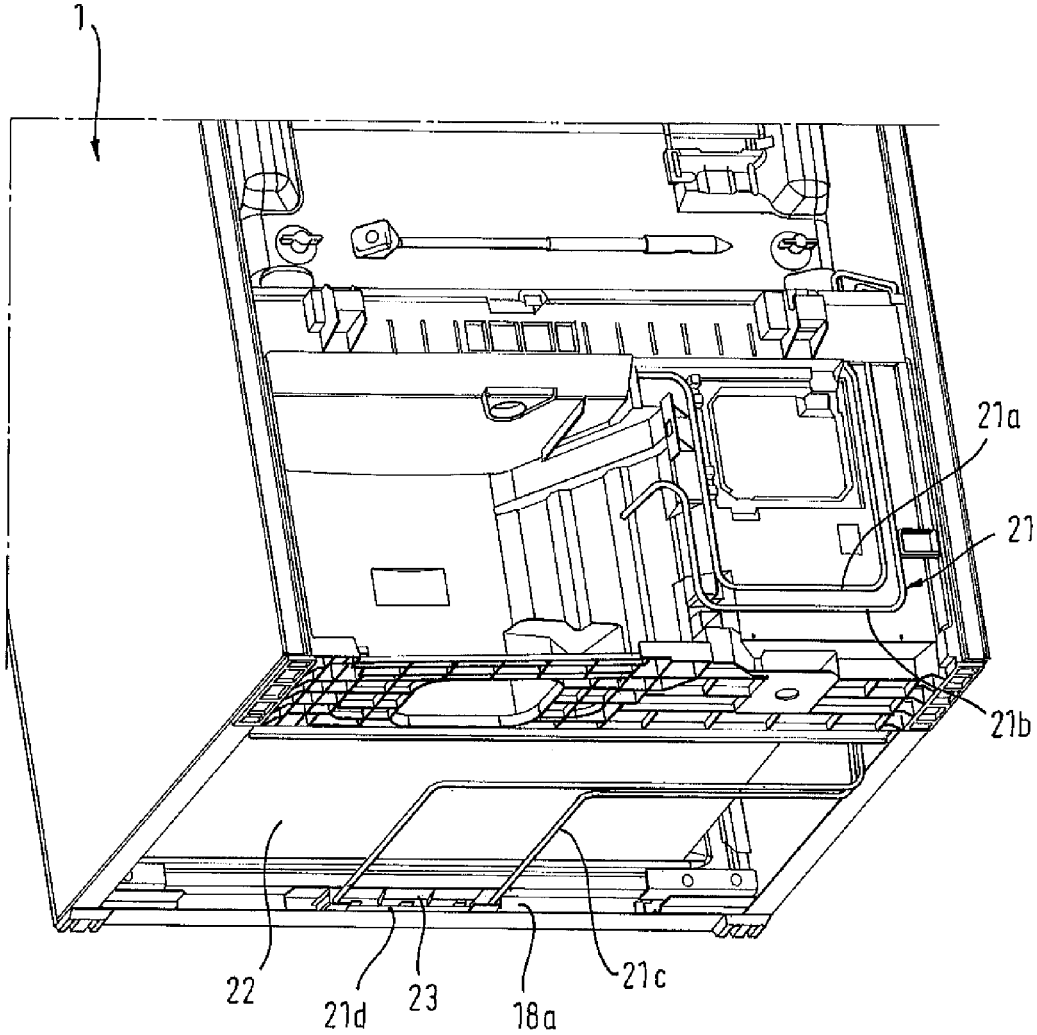
FIG. 2 shows a perspective view from below of the back of the refrigeration device from FIG. 1, with the refrigerant compressor removed.

FIG. 2 is a partial rear view of the refrigeration device 1 from the side opposite the doors 3 and 5, showing the lower part of the refrigeration device 1 with the back wall and refrigerant compressor 12 removed. A first section 21*a* of a refrigerant line 21 leads from the evaporator 14 shown in FIG. 1 to an inlet of the refrigerant compressor 12. On the hot side of the refrigerant circulation system 11, a second section 21*b* of the refrigerant line 21 leads from an outlet of the refrigerant compressor 12 to a pipe loop 21*c*. The pipe loop 21*c* is run from the back to the front of the refrigeration device 1 along a base 22. In a central area of the front trim strip 18*a* near the base, a third section 21*d* of the pipe loop 21*c*, i.e. of the refrigerant line 21, runs along the back of the trim strip 18*a*. The third section 21*d* of the pipe loop 21*c* in retained in a fixed position with respect to the trim strip 18*a* by means of a holder 23.

Figure 3:
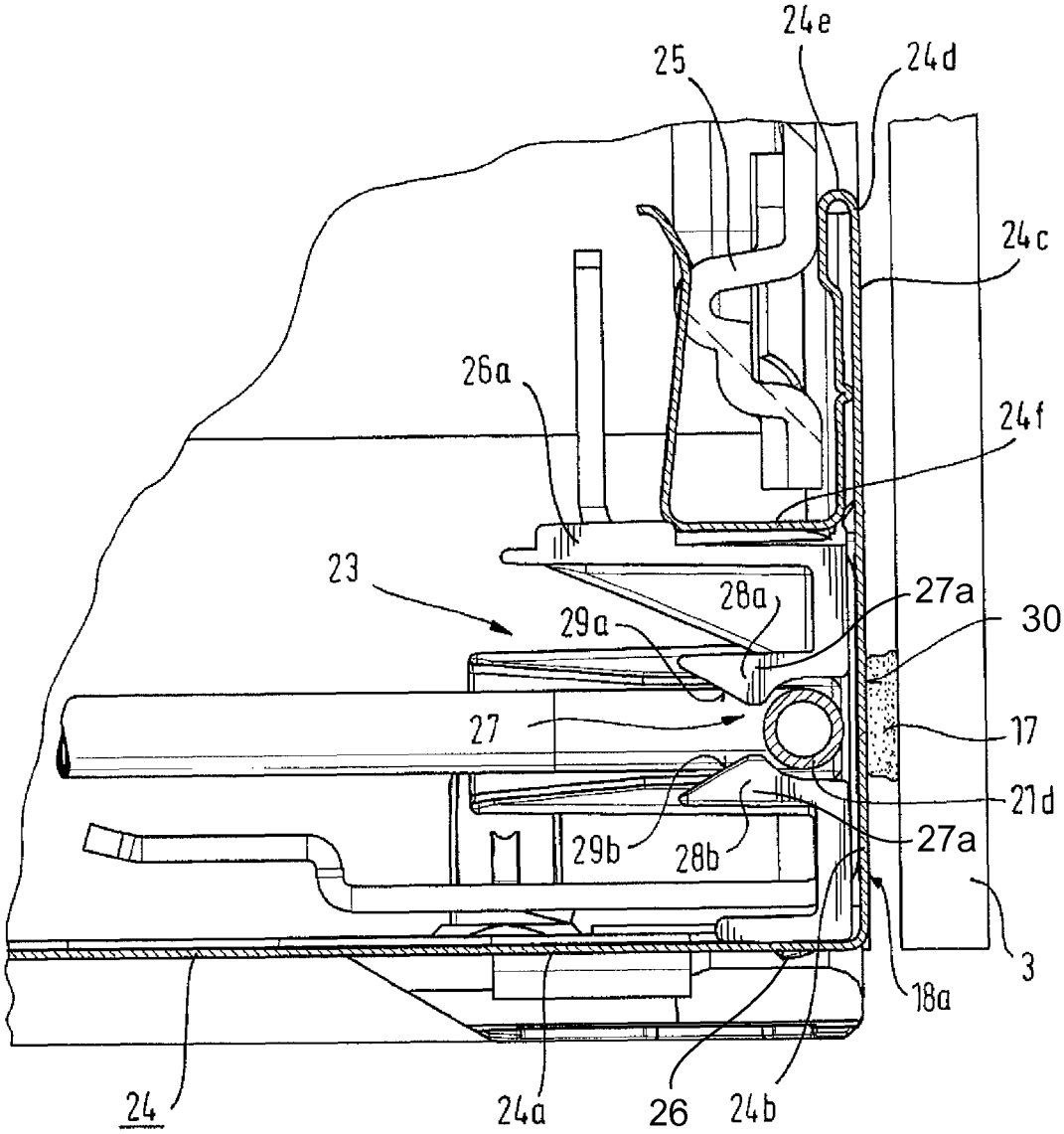
FIG. 3 shows a partial sectional view through a holder according to the invention in the region of a front trim strip disposed at the bottom.

The holder 23 is shown in a sectional view in FIG. 3. The view illustrated shows a section through the lower base-end trim strip 18*a* of the refrigeration device 1 in the center of the width of the trim strip 18*a* in a lower corner area of the refrigeration device 1. A bent sheet metal part 24 has a base-end flat first sheet metal section 24*a*. The trim strip 18*a* connects to the bent sheet metal section 24*a* in a second bent sheet metal section 24*b* bent upward at right angles. The trim strip 18*a* is continued upward in a straight line into a third bent sheet metal section 24*c*. At an upper end 24*d* of the bent sheet metal part 24, the metal is folded round through 360°. This fold 24*e* is followed by a receiving section 24*f* bent in a U-shape into which an outer edge of an inner container 25 of the refrigeration device is inserted. On the front of the trim strip 18*a*, the door seal 17 is in contact with a contact surface 30 of the trim strip 18*a*. The door seal 17 is attached to the first door 3.

In cross section, the holder 23 has essentially a U-shape which is matched to the shape and size of the bent sections 24*a* to 24*d* and the receiving section 24*f*. To mount it, the holder 23 is pressed from the back of the trim strip 18*a* into the channel-like bent sheet metal part 24 where it is clamped or locked by means of a snap-in element 26*a*, said snap-in element 26*a* constituting a first retaining means 26 for pre-fixing the holder 23 to the back of the trim strip 18*a*.

The section 21*d* of the pipe loop 21*c* is then fastened to the holder 23 by means of a second retaining means 27. The second retaining means 27 is implemented as locking clips 27*a* which grip the section 21*d* of the pipe loop 21*c* in a pincer-like manner. Each locking clip 27*a* has two opposite latching tongues 28*a* and 28*b*. A thrust bevel 29*a*, 29*b* is implemented at the free ends of each latching tongue 28*a*, 28*b*.

The invention claimed is:

1. A domestic refrigeration device comprising:

a refrigerated chamber body;

a door;

a refrigerated chamber defined at least in part by the refrigerated chamber body, the refrigerated chamber having an opening closable by the door;

a door seal;

a trim strip structured to contact the door seal to seal the refrigerated chamber when the door is in a closed position;

and a refrigerant circulation system including a refrigerant line and an evaporator, the refrigerant line and the evaporator being in fluid communication, and the evaporator structured to remove heat energy from the refrigerated chamber, wherein the refrigerant line includes a heat-emitting section adjacent to a rear side of the trim strip, the rear side of the trim strip being a side of the trim strip that is opposite the door seal when the door is in the closed position, and wherein the heat-emitting section is positioned entirely below the refrigerated chamber.

2. The domestic refrigeration device as claimed in claim 1, wherein the heat-emitting section of the refrigerant line is adjacent to a central portion of the rear side of the trim strip with the of said central portion being less than a total length of said trim strip.

3. The domestic refrigeration device as claimed in claim 1, wherein the heat-emitting section of the refrigerant line comprises a part of a pipe loop of a high-pressure side of the refrigerant circulation system.

4. The domestic refrigeration device as claimed in claim 1, wherein the refrigerant circulation system includes a refrigerant compressor and a condenser.

5. The domestic refrigeration device as claimed in claim 1, further comprising a holder structured to hold the heat-emitting section of the refrigerant line adjacent to the rear side of the trim strip.

6. The domestic refrigeration device as claimed in claim 5, wherein the holder comprises a first retainer structured to connect the holder to the rear side of the trim strip and the holder comprises a second retainer structured to retain the heat-emitting section of the refrigerant line adjacent to the rear side of the trim strip.

7. The domestic refrigeration device as claimed in claim 6, wherein the first retainer comprises a snap-in element structured to fasten the holder to a bent sheet metal section of the trim strip.

8. The domestic refrigeration device as claimed in claim 6, wherein the second retainer comprises at least one locking clip structured to retain the heat-emitting section of the refrigerant line in a pincer-like manner.

9. The domestic refrigeration device as claimed in claim 8, wherein each of the at least one locking clip comprises two opposite latching tongues, each of the two opposite latching tongues having a clamping surface structured to be positioned against opposite sides of the heat-emitting section of the refrigerant line, and each of the two opposite latching tongues having a thrust bevel to allow the latching tongues to widen during insertion of the heat-emitting section of the refrigerant line into a corresponding one of the at least one locking clip.

10. The domestic refrigeration device as claimed in claim 1, wherein the total length of the heat-emitting section is less than the total length of the trim strip.

11. The domestic refrigeration device as claimed in claim 10, wherein the length of the heat-emitting section is between 25% and 50% of the total length of the trim strip.

12. The domestic refrigeration device as claimed in claim 1, wherein the trim strip comprises metal.

13. A method for preventing condensation on a surface of a domestic refrigeration device, the method comprising:

circulating refrigerant through a refrigerant circulation system to remove heat from a refrigerated chamber with an evaporator, the refrigerant circulation system including a refrigerant line in fluid communication with the evaporator, and said refrigerated chamber defined at least in part by a refrigerated chamber body and a door when the door is in a closed position; and dissipating heat energy in the refrigerant from a heat-emitting section of the refrigerant line to a rear side of a trim strip, wherein the heat-emitting section of the refrigerant line is adjacent the rear side of the trim strip, the rear side of the trim strip being a side of the trim strip that is opposite a door seal of the door, the door seal contacting the trim strip when the door is in the closed position, and wherein the heat-emitting section is positioned entirely below the refrigerated chamber.

14. The method as claimed in claim 13, further comprising dissipating heat energy from the heat-emitting section to a central portion of the rear side of the trim strip, wherein the length of said central portion is less than the total length of said trim strip.

15. The method as claimed in claim 13, wherein the heat-emitting section of the refrigerant line comprises a part of a pipe loop of a high-pressure side of the refrigerant circulation system.

16. The method as claimed in claim 13, further comprising:

compressing and driving the refrigerant through the refrigerant circulation system with a refrigerant compressor; and dissipating heat energy from the refrigerant a condenser.

17. The method as claimed in claim 13, wherein the length of the heat-emitting section is less than the total length of the trim strip.

18. The method as claimed in claim 17, wherein the length of the heat-emitting section is between 25% and 50% of the total length of the trim strip.

19. The method as claimed in claim 13, further comprising a holder structured to hold the heat-emitting section of the refrigerant line adjacent to the rear side of the trim strip.

20. The method as claimed in claim 19, wherein the holder comprises a first retainer structured to connect the holder to the rear side of the trim strip and the holder comprises a second retainer structured to retain the heat-emitting section of the refrigerant line adjacent to the rear side of the trim strip.

21. The method as claimed in claim 20, wherein the first retainer comprises a snap-in element structured to fasten the holder to a bent sheet metal section of the trim strip.

22. The method as claimed in claim 20, wherein the second retainer comprises at least one locking clip structured to retain the heat-emitting section of the refrigerant line in a pincer-like manner.

23. The method as claimed in claim 13, wherein the trim strip comprises metal.

24. A domestic refrigeration device comprising:

a refrigerated chamber body;

a door;

a refrigerated chamber defined at least in part by the refrigerated chamber body, the refrigerated chamber having an opening closable by the door;

a door seal;

a trim strip structured to contact the door seal to seal the refrigerated chamber when the door is in a closed position;

a refrigerant line; and a refrigerant circulation system structured to remove heat energy from the refrigerated chamber via an evaporator, the evaporator being in fluid communication with the refrigerant line, wherein the refrigerant line includes a heat-emitting section adjacent to a rear side of the trim strip, the rear side of the trim strip being a side of the trim strip that is opposite the door seal when the door is in the closed position, and wherein the length of the heat-emitting section is less than the total length of the trim strip.

25. The domestic refrigeration device as claimed in claim 24, wherein the heat-emitting section of the refrigerant line is adjacent to a central portion of the rear side of the trim strip and a length of said central portion being less than a total length of said trim strip.

26. The domestic refrigeration device as claimed in claim 24, wherein the heat-emitting section of the refrigerant line comprises a part of a pipe loop of a high-pressure side of the refrigerant circulation system.

27. The domestic refrigeration device as claimed in claim 24, wherein the refrigerant circulation system includes a refrigerant compressor and a condenser.

28. The domestic refrigeration device as claimed in claim 24, further comprising a holder structured to hold the heat-emitting section of the refrigerant line adjacent to the rear side of the trim strip.

29. The domestic refrigeration device as claimed in claim 28, wherein the holder comprises a first retainer structured to connect the holder to the rear side of the trim strip and the holder comprises a second retainer structured to retain the heat-emitting section of the refrigerant line adjacent to the rear side of the trim strip.

30. The domestic refrigeration device as claimed in claim 29, wherein the first retainer comprises a snap-in element structured to fasten the holder to a bent sheet metal section of the trim strip.

31. The domestic refrigeration device as claimed in claim 29, wherein the second retainer comprises at least one locking clip structured to retain the heat-emitting section of the refrigerant line in a pincer-like manner.

32. The domestic refrigeration device as claimed in claim 31, wherein each of the at least one locking clip comprises two opposite latching tongues, each of the two opposite latching tongues having a clamping surface structured to be positioned against opposite sides of the heat-emitting section of the refrigerant line, and each of the two opposite latching tongues having a thrust bevel to allow the latching tongues to widen during insertion of the heat-emitting section of the refrigerant line into a corresponding one of the at least one locking clip.

33. The domestic refrigeration device as claimed in claim 28, wherein a length of the holder is between 25% and 50% of the total length of the trim strip.

34. The domestic refrigeration device as claimed in claim 24, wherein the length of the heat-emitting section is between 25% and 50% of the total length of the trim strip.

35. The domestic refrigeration device as claimed in claim 24, wherein the trim strip comprises metal.

* * * * *

UNITED STATES PATENT AND TRADEMARK OFFICE

CERTIFICATE OF CORRECTION

PATENT NO. : 8,899,070 B2
APPLICATION NO. : 12/679698
DATED : December 2, 2014
INVENTOR(S) : Eckartsberg et al.

It is certified that error appears in the above-identified patent and that said Letters Patent is hereby corrected as shown below:

In the Claims

Column 6, Claim 2, line 4: "with the of said central portion being less than a total length of" should be corrected to read: --with the length of said central portion being less than a total length of--.

Column 8, Claim 25, line 4: "and a length of said central portion being less than a total" should be corrected to read: --with the length of said central portion being less than the total--.

Signed and Sealed this
Third Day of March, 2015

Michelle K. Lee

Michelle K. Lee
*Deputy Director of the United States Patent and Trademark Office*